US008324818B2

(12) United States Patent
Kunimori et al.

(10) Patent No.: US 8,324,818 B2
(45) Date of Patent: Dec. 4, 2012

(54) DISPLAY DEVICE

(75) Inventors: Takashi Kunimori, Tottori (JP); Yukiya Hirabayashi, Suwa (JP)

(73) Assignee: Sony Corporation, Tokyo (JP)

( * ) Notice: Subject to any disclaimer, the term of this patent is extended or adjusted under 35 U.S.C. 154(b) by 743 days.

(21) Appl. No.: 12/549,427

(22) Filed: Aug. 28, 2009

(65) Prior Publication Data

US 2010/0127628 A1 May 27, 2010

(30) Foreign Application Priority Data

Nov. 21, 2008 (JP) ..... 2008-297670

(51) Int. Cl.
*H05B 37/02* (2006.01)

(52) U.S. Cl. ..... 315/157; 315/308; 315/360; 345/102

(58) Field of Classification Search ..... 315/149, 315/157, 291, 307, 308, 360; 345/102; 250/200, 250/206

See application file for complete search history.

(56) References Cited

U.S. PATENT DOCUMENTS 7,589,305 B2 * 9/2009 Kunimori et al. ..... 250/208.1
7,885,778 B2 * 2/2011 Hirabayashi et al. ..... 702/104
7,936,346 B2 * 5/2011 Kunimori et al. ..... 345/207
2008/0001070 A1 1/2008 Nakamura et al.
2008/0079860 A1 4/2008 Kunimori et al.
2008/0297466 A1 * 12/2008 Kunimori et al. ..... 345/102

FOREIGN PATENT DOCUMENTS

JP 2007-279100 10/2007
JP 2007-316243 12/2007
JP 2008-083313 4/2008

* cited by examiner

*Primary Examiner* — Thuy Vinh Tran
(74) *Attorney, Agent, or Firm* — K&L Gates LLP

(57) ABSTRACT

A display device includes: a display panel; an optical detector which includes an optical sensor formed by a thin film transistor for detecting external light and a capacitor connected between a pair of electrodes of the optical sensor; a switch which turns on or off a charging operation of the capacitor; an optical sensor controller which controls the switch to be turned on or off and measures illumination of the external light on the basis of a time period during which the switch is turned off and a voltage of the capacitor becomes a value not more than a threshold value; and a controller which controls brightness of the display panel on the basis of an output of the optical sensor controller, wherein after the optical sensor controller detects a fact that the voltage of the capacitor becomes the value not more than the threshold value, the optical sensor controller turns on the switch after a predetermined time.

6 Claims, 10 Drawing Sheets

10

DISPLAY DEVICE

BACKGROUND

1. Technical Field

The present invention relates to a display device equipped with an optical sensor which is formed by a TFT (Thin Film Transistor) for detecting external light and an optical detector which has a capacitor connected between a pair of electrodes of the optical sensor. More specifically, the present invention relates to a display device equipped with an optical sensor and an optical detector capable of allowing a display screen to be quickly seen by quickly detecting external light particularly when a peripheral environment changes from a dark state to a bright state.

2. Related Art

As display devices, there are known various display devices such as a CRT (Cathode Ray Tube), a liquid crystal display device, an LED (Light Emitting Diode) display device, a plasma display device, and an organic EL display device. Among the various display devices, the liquid crystal display device is more widely used than the CRT for the purpose of a display in many electronic apparatuses due to the light weight, the thin thickness, and the low power consumption thereof. The liquid crystal display device displays an image thereon in such a manner that the directions of liquid crystal molecules aligned in a predetermined direction are changed by an electric field so as to change a light transmission amount of a liquid crystal layer. As the types of the liquid crystal display device, there are known a reflection type, a transmission type, and a semi-transmission type. Specifically, the reflection type has a structure in which external light transmits through a liquid crystal layer, is reflected by a reflection member, transmits through the liquid crystal layer again, and then is emitted to the outside. The transmission type has a structure in which light incident from a backlight unit transmits through the liquid crystal layer. The semi-transmission type has both characteristics of the reflection type and the transmission type.

The liquid crystal display device of the reflection type is advantageous in that the power consumption is small since the external light is used as a light source, but is disadvantageous in that an image displayed thereon is difficult to be seen in a dark place. The liquid crystal display device of the transmission type is advantageous in that an image displayed thereon is easily seen even in a dark place, but is disadvantageous in that the power consumption is large since the backlight unit is required to be turned on all the time.

In the liquid crystal display device of the semi-transmission type, one sub-pixel region has a transmission region and a reflection region. In a dark place, the backlight unit is turned on to display an image via the transmission region. In a bright place, the external light in the reflection region is used to display an image without using the backlight unit. For this reason, the liquid crystal display device of the semi-transmission type is advantageous in that the power consumption is remarkably reduced since the backlight unit is not required to be turned on all the time. Particularly, the liquid crystal display device of the semi-transmission type is widely used in portable electronic apparatuses.

Meanwhile, in the liquid crystal display devices of the transmission type and the semi-transmission type, JP-A-2007-316243 discloses a technology in which an optical sensor used to detect external light is provided in the liquid crystal display device so as to decrease brightness of a backlight unit in the case of dark external light and to increase the brightness of the backlight unit in the case of the bright external light, thereby allowing the image to be easily seen even when the peripheral brightness changes. Similarly, in the liquid crystal display device of the semi-transmission type, JP-A-2008-83313 discloses a technology in which a backlight unit is turned off so as to display an image in a reflection region in a bright place and the backlight unit is turned on so as to display the image in a transmission region in a dark place. Even in other display devices, similarly, the brightness of the display device is automatically changed so as to allow the image to be easily seen in the case where the peripheral brightness changes.

In the liquid crystal display device disclosed in JP-A-2007-316243, a photo diode provided in a liquid crystal panel is used as the optical sensor. However, when the photo diode is used as the optical sensor, a problem arises in that the number of manufacture processes of the liquid display panel increases. For this reason, in the liquid crystal display devices disclosed in JP-A-2008-83313 and JP-A-2007-279100, an optical sensor formed by a TFT simultaneously formed with a TFT for driving the liquid crystal display panel is used as the optical sensor. The optical sensor formed by the TFT functions as an optical conductive element in which a leakage current caused by optical leakage increases in accordance with an increase of illumination, where the illumination is measured in accordance with an amount in which a voltage caused by electric charge accumulated in a capacitor (condenser) decreases due to the leakage current of the optical leakage.

As described above, in the known method of measuring the illumination of the external light by using the optical sensor formed by the TFT, there are known a method in which the illumination of the external light is measured on the basis of the voltage of the capacitor after a predetermined time and a method in which the illumination of the external light is measured by measuring a time until a voltage of the capacitor becomes a value not more than a threshold value. Among the methods, an operation of a known optical sensor controller for measuring the illumination of the external light by measuring the time until the voltage of the capacitor becomes the value not more than the threshold value will be described with reference to FIG. 11.

In addition, FIG. 11 is a time chart showing waveforms of the respective parts when the known optical sensor controller shown in FIG. 11 measures illumination.

In an output curve in FIG. 11, the left side thereof indicates a high-illumination (bright) region, and the right side thereof indicates a low-illumination (dark) region. Here, a time period during which a voltage Vs of a fully charged capacitor decreases to a predetermined threshold value Vth is indicated by a time period t9 (bright state) and a time period t11 (dark state). As apparently shown in the output curve in FIG. 11, in the optical sensor formed by a TFT as an optical conductive element, since a current flowing by the optical leakage is minute in the low-illumination region, the period t11 until the voltage of the capacitor becomes the value not more than the threshold value becomes longer than the period t9 corresponding to the high-illumination region.

For this reason, an illumination detection period (sampling time) W is set to a predetermined long period of time value in order to use the optical sensor for the purpose of controlling the backlight unit of the liquid crystal display device, and particularly, for the purpose of the detection in the low-illumination region. In addition, a time period a, a process time period b, and a time period c are set to a predetermined period of time set in advance in accordance with a performance of a signal processor, where the time period a indicates a time period during which electric charge is fully charged in the capacitor, the process time period b indicates a time period during which a calculation is started and an illumination determination det is carried out, and the time period c indicates a time period during which the charging operation of the capacitor is started after the illumination determination det. Accordingly, since the W, a, b, and c are uniform, when a delay time period during which the voltage Vs of the fully charged capacitor decreases to the predetermined threshold value Vth and a calculation for the illumination determination is started is indicated by time periods t10 (bright state) and t12 (dark state), $$W = a + t9 + t10 + b + c$$
$$= a + t11 + t12 + b + c$$
$$= \text{uniform}$$

When the above-described equation is rearranged, $$W - (a + b + c) = t9 + t10$$
$$= t11 + t12$$
$$= \text{uniform}$$

As is clear from above, the delay time period t10 in the bright state becomes longer than the delay time period t12 in the dark state. The delay time periods t10 and t12 are delay time periods until the illumination determination. For this reason, according to the known illumination measuring method, since the delay time period t10 in the bright state becomes longer than the delay time period t12 in the dark state, a problem arises in that the brightness control of the backlight unit is late particularly when the peripheral environment becomes bright suddenly.

Further, JP-A-2007-279100 discloses a technology in which a level of a gate voltage of an optical sensor formed by a TFT is changed for a low-illumination purpose and a high-illumination purpose in order to solve such a problem that a discharge time of the electric potential accumulated in a capacitor is long in the case where the external light is dark. However, it is disadvantageous in that a manufacture cost increases when a plurality of voltage application members is provided so as to apply a voltage to the gate voltage of the optical sensor formed by the TFT.

SUMMARY

An advantage of some aspects of the invention is that it provides a display device capable of allowing a display screen to be quickly seen by measuring illumination without any delay when a peripheral environment of the display device suddenly changes from a dark state to a bright state.

In order to achieve the above-described object, according to an aspect of the invention, there is provided a display device including: a display panel; an optical detector which includes an optical sensor formed by a TFT for detecting external light and a capacitor connected between a pair of electrodes of the optical sensor; a switch which turns on or off a charging operation of the capacitor; an optical sensor controller which controls the switch to be turned on or off and measures illumination of the external light on the basis of a time period during which the switch is turned off and a voltage of the capacitor becomes a value not more than a threshold value; and a controller which controls brightness of the display panel on the basis of an output of the optical sensor controller, wherein after the optical sensor controller detects a fact that the voltage of the capacitor becomes the value not more than the threshold value, the optical sensor controller turns on the switch after a predetermined time.

In the display device according to the aspect of the invention, the optical sensor controller detects a fact that the voltage of the capacitor becomes the voltage not more than the threshold value and turns on the switch after the predetermined time so as to start the charging operation of the capacitor. The predetermined time is appropriately set within a time longer than a time required for the illumination determination of the external light carried out by the optical sensor controller. That is, in the display device, since the charging operation of the capacitor is started after the predetermined time longer than the time required for the illumination determination of the external light after the voltage of the capacitor becomes the value not more than the threshold value, the measurement period becomes shorter in the case of the bright external light and becomes longer in the case of the dark external light. For this reason, according to the display device, even when the illumination of the external light suddenly changes from the dark state to the bright state, it is possible to immediately detect the changed state. Accordingly, it is possible to immediately have the brightness comfortable for seeing the display screen without such a problem that the brightness of the display device in the dark state is maintained. In addition, "the brightness of the display device" in the invention indicates the brightness of the display screen as well as the brightness of back light or front light.

In the display device, the pair of electrodes of the optical sensor may be a source electrode and a drain electrode of the TFT.

In the display device, since the optical sensor is formed by the TFT, it is possible to simultaneously form the optical sensor together with a TFT generally used as a switching element or a peripheral circuit element of the display device, and thus to decrease the number of manufacture processes.

In the display device, after the optical sensor controller detects a fact that the voltage of the capacitor becomes the value not more than the threshold value, the optical sensor controller may apply a positive bias voltage to a gate electrode of the optical sensor before turning on the switch.

The optical sensor controller uses the principle that the leakage current of the TFT of the optical sensor is proportional to the illumination of the external light. That is, electric charge accumulated in a voltage detecting condenser is discharged by the leakage current, and a variation in voltage across opposite ends of the condenser at this time is monitored, thereby detecting the illumination of the external light. The optical sensor controller applies a predetermined fixed negative bias voltage to the gate electrode of the TFT of the optical sensor upon detecting the illumination of the external light, but a problem arises in that a variation in threshold value of the TFT of the optical sensor is caused by biased polarity when the negative bias voltage is continuously applied. Therefore, in the display device, a reset operation of allowing the capacitor to be in a short-circuit state is carried out in such a manner that the optical sensor controller periodically applies a predetermined fixed positive bias voltage to the gate electrode of the TFT of the optical sensor. According to the display device, since all the electric charge of the capacitor is periodically discharged, the measurement condition for each period is uniform. Also, since a variation in threshold value can be prevented by continuously applying a predetermined fixed negative bias voltage to the gate electrode, it is possible to maintain the reliability in the detection precision of the illumination of the external light.

In the display device, the optical sensor controller may set a time period during which the positive bias voltage is applied to the gate electrode of the optical sensor so as to be proportional to a time period during which the switch is turned off in a precedent process and the voltage of the capacitor becomes the value not more than the threshold value.

In the display device, the reset operation of allowing the capacitor to be in a short-circuit state is carried out in such a manner that the optical sensor controller periodically applies a predetermined fixed positive bias voltage to the gate electrode of the TFT of the optical sensor so as to turn on the TFT and to allow the capacitor to be in a short-circuit state. However, when a ratio between the application time of the positive bias voltage and the application time of the negative bias voltage deviates from a certain fixed value, it is not possible to prevent a variation in threshold value of the TFT of the optical sensor.

Therefore, in the display device, the optical sensor controller sets a time period during which a positive bias voltage is applied to the gate electrode of the optical sensor to a time period during which the switch is turned off in the precedent process and the voltage of the capacitor becomes a value not more than the threshold value, that is, a time period which is proportional to the application time of the negative bias voltage. Thus, according to the display device, since it is possible to set a uniform ratio between the application time of the positive bias voltage applied to the gate electrode of the TFT of the optical sensor and the application time of the negative bias voltage thereof, it is possible to prevent a variation in threshold value of the TFT of the optical sensor.

In the display device, the optical sensor controller may store in advance a lower limit value of the time period during which the voltage of the capacitor becomes the value not more than the threshold value, and in the case where the time period during which the voltage of the capacitor becomes the value not more than the threshold value is shorter than the lower limit value, the optical sensor controller may adopt the lower limit value as an illumination measurement value of the external light and turns on the switch after the lower limit value and the predetermined time.

Since the voltage of the capacitor decreases exponentially, the voltage of the capacitor becomes a value not more than the threshold value in a short time when the illumination of the external light is too high. In addition, a brightness range which is the most comfortable for a user of the display device is narrow. According to the display device, in the case where the time period during which the voltage of the capacitor becomes a value not more than the threshold value is shorter than the lower limit value, the lower limit value is used as the illumination of the external light, thereby preventing the detection error caused when the illumination of the external light is too high.

In the display device, the optical sensor controller may store in advance an upper limit value of the time period during which the voltage of the capacitor becomes the value not more than the threshold value, and in the case where the voltage of the capacitor does not become the value not more than the threshold value even at the upper limit value, the optical sensor controller may adopt the upper limit value as an illumination measurement value of the external light and turns on the switch after the upper limit value and the predetermined time.

Since the voltage of the capacitor decreases exponentially, it takes a long time until the voltage of the capacitor becomes a value not more than the threshold value when the illumination of the external light is too low, which causes such a problem that the measurement value may not be obtained within a predetermined measurement period. In addition, the brightness range which is the most comfortable for the user of the display device is narrow. According to the display device, in the case where the voltage of the capacitor does not become a value not more than the threshold value even in a predetermined maximum time, the upper limit value is used as the illumination of the external light, thereby preventing the detection error caused when the illumination of the external light is too low.

BRIEF DESCRIPTION OF THE DRAWINGS

The invention will be described with reference to the accompanying drawings, wherein like numbers reference like elements.

DESCRIPTION OF EXEMPLARY EMBODIMENTS

Preferred embodiments of the invention are described hereafter by exemplifying a liquid crystal display device with reference to the embodiments and drawings. However, in the embodiments described below, the invention is not limited to the liquid crystal display device, and may be modified into various forms without departing from the technical spirit shown in claims. Further, in the respective drawings used for the description in this specification, the layers or members may be shown having dimensions different from their actual dimensions to aid understanding of figures referred to in relation to the following description.

Figure 1:
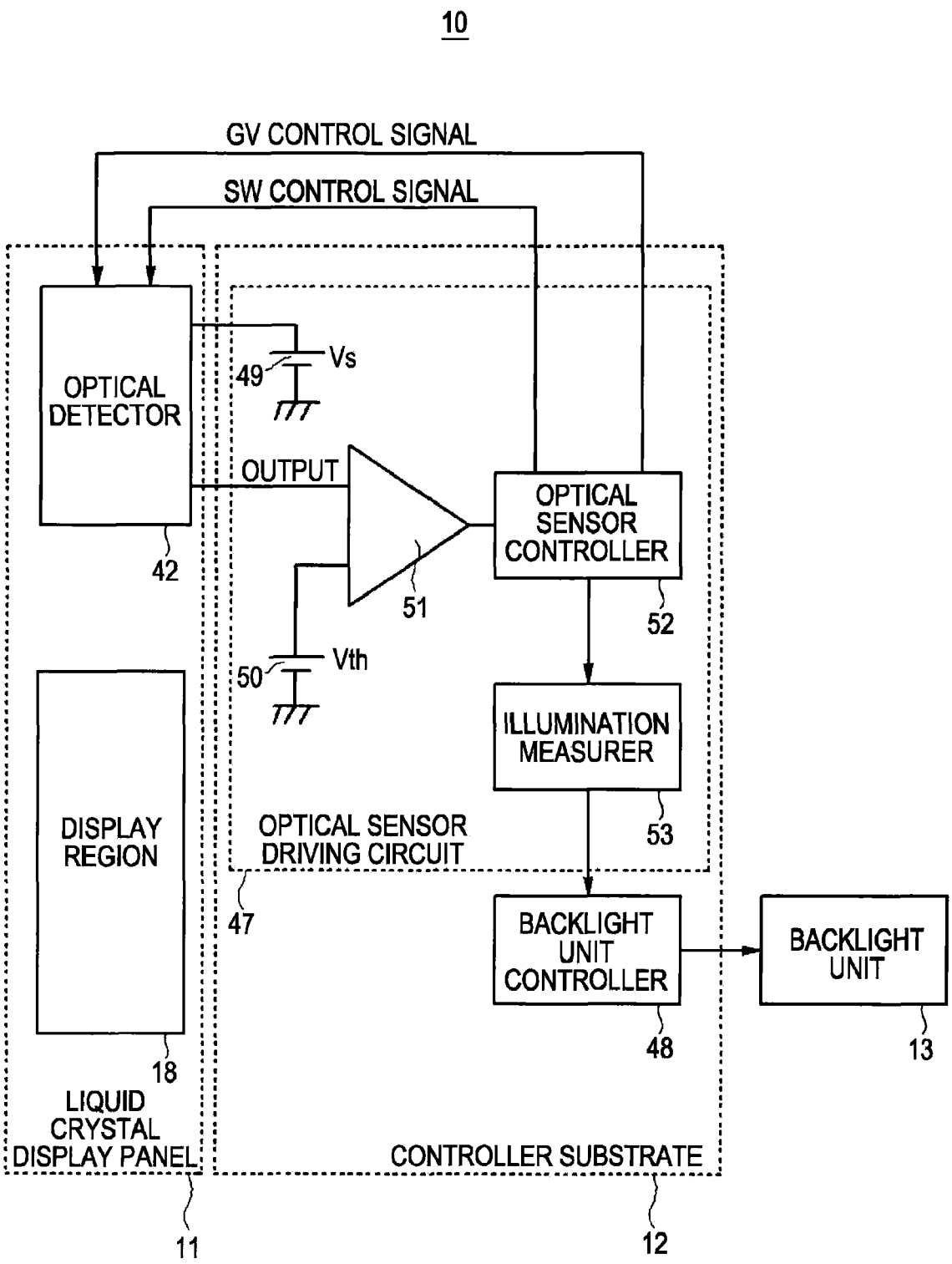
FIG. 1 is a block diagram showing a main part of a liquid crystal display device according to the embodiments.
Figure 2:
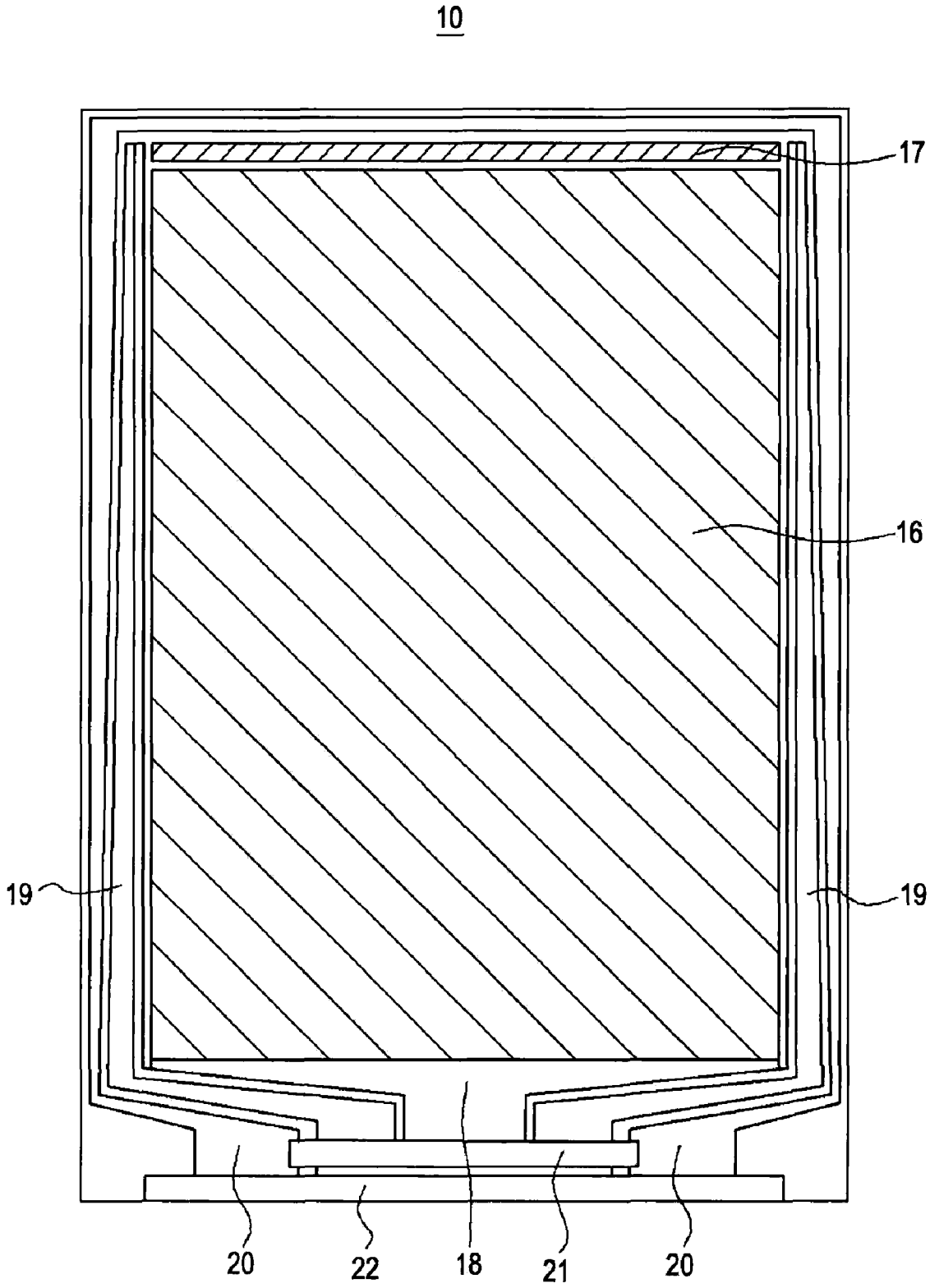
FIG. 2 is a top view perspectively showing a color filter substrate of the liquid crystal display device according to the embodiments.
Figure 3:
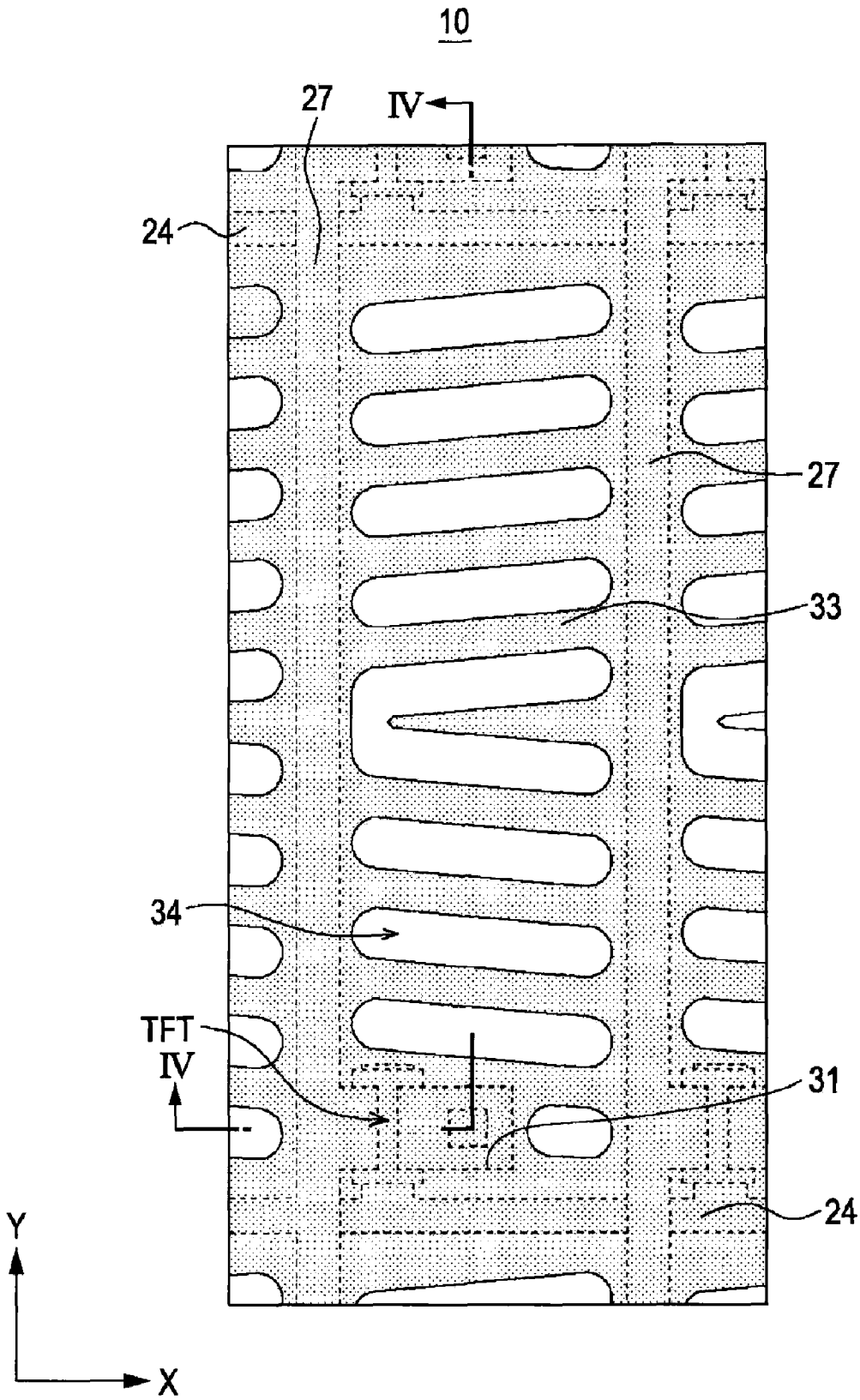
FIG. 3 is a top view showing an outline of one sub-pixel of the liquid crystal display device according to the embodiments.
Figure 4:
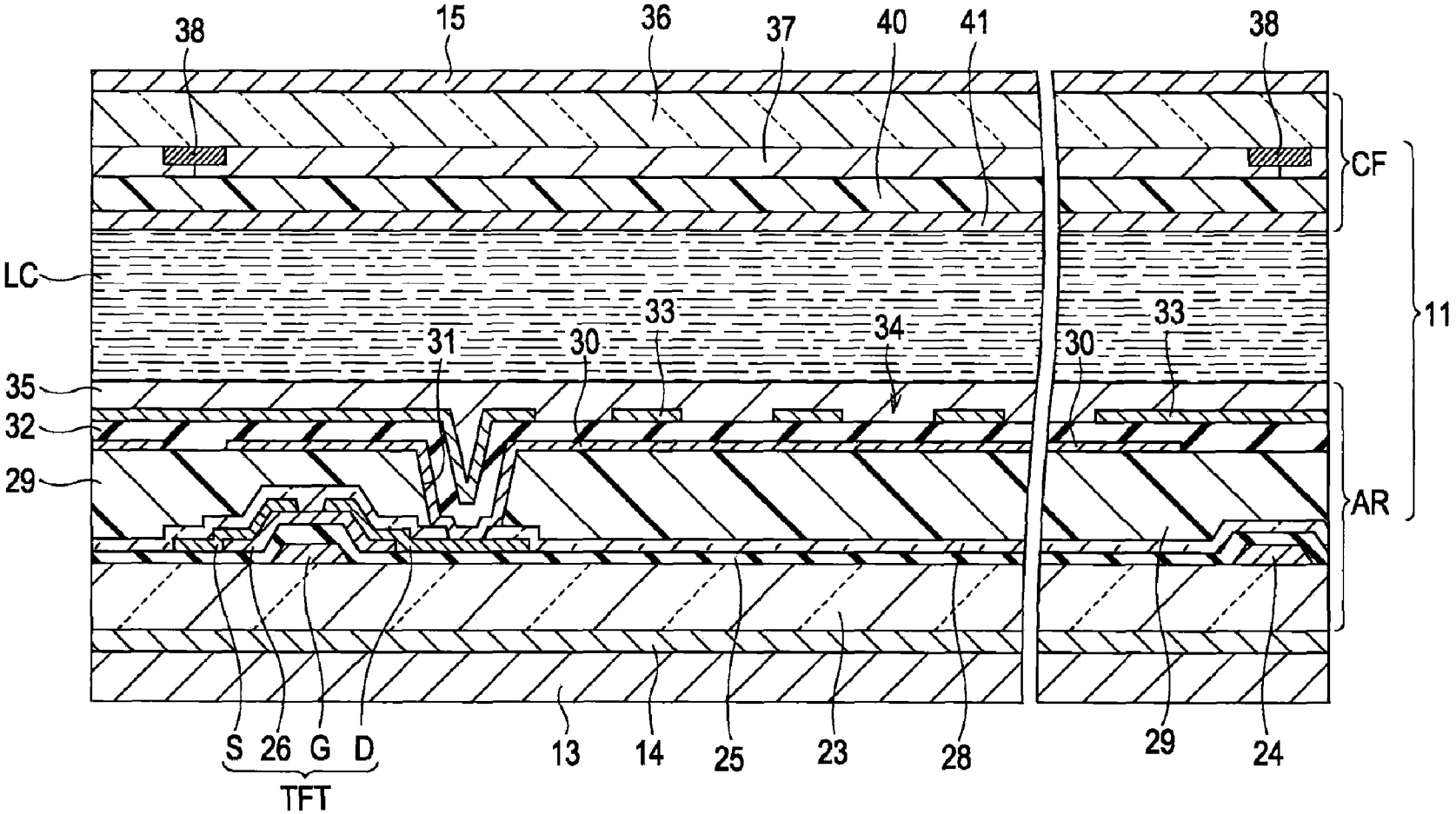
FIG. 4 is a cross-sectional view taken along the line IV-IV in FIG. 3.
Figure 5:
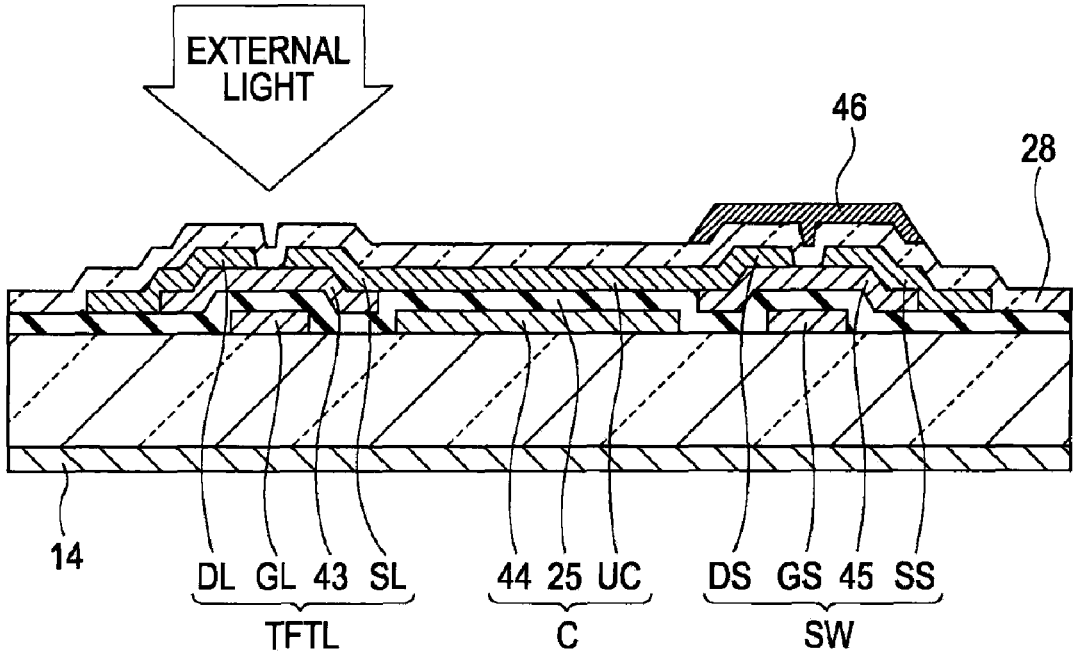
FIG. 5 is a cross-sectional view showing an outline of an optical detector of the liquid crystal display device according to the embodiments.
Figure 6:
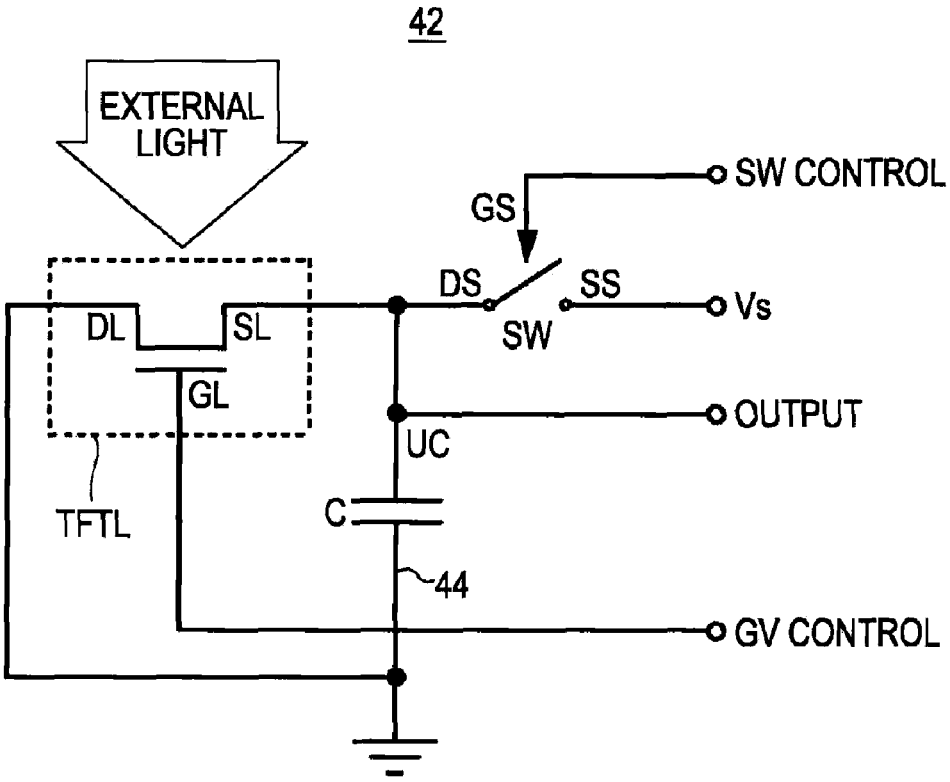
FIG. 6 is an equivalent circuit diagram showing the optical detector in FIG. 4.
Figure 7:
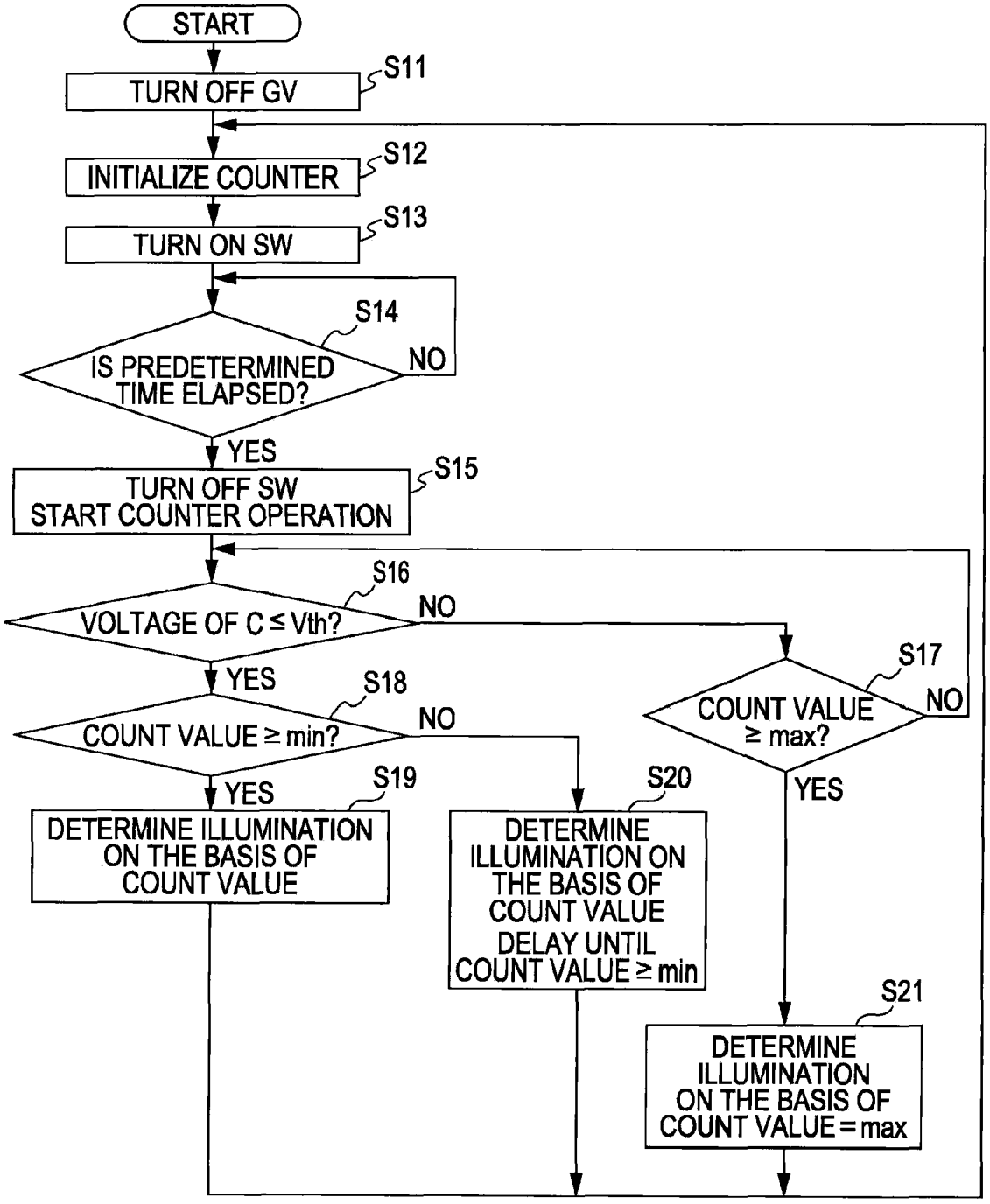
FIG. 7 is a flowchart showing an operation of an optical sensor controller according to the first embodiment.
Figure 8A:
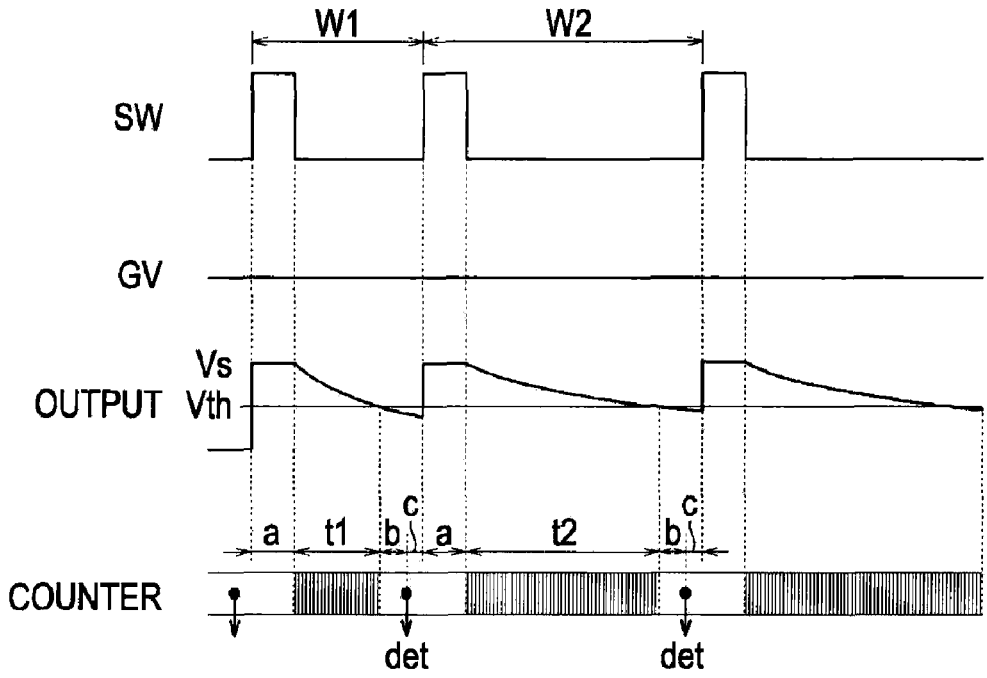
FIG. 8A is a time chart showing waveforms of respective parts when the optical sensor controller according to the first embodiment is in a normal illumination state.
Figure 8B:
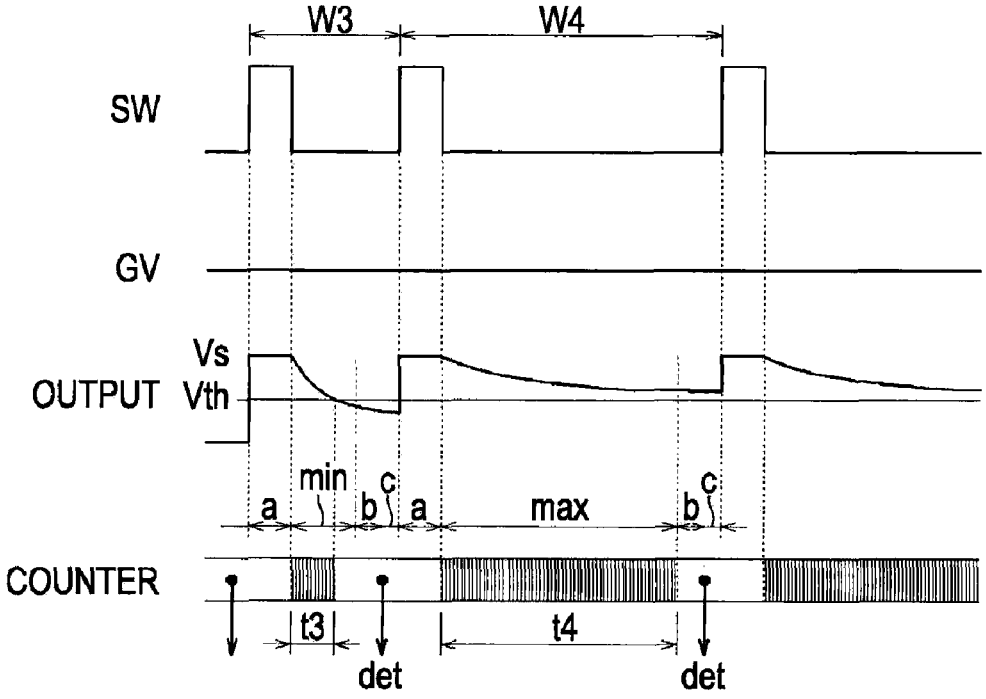
FIG. 8B is a time chart showing waveforms of respective parts when the optical sensor controller is in an abnormal state.
Figure 9:
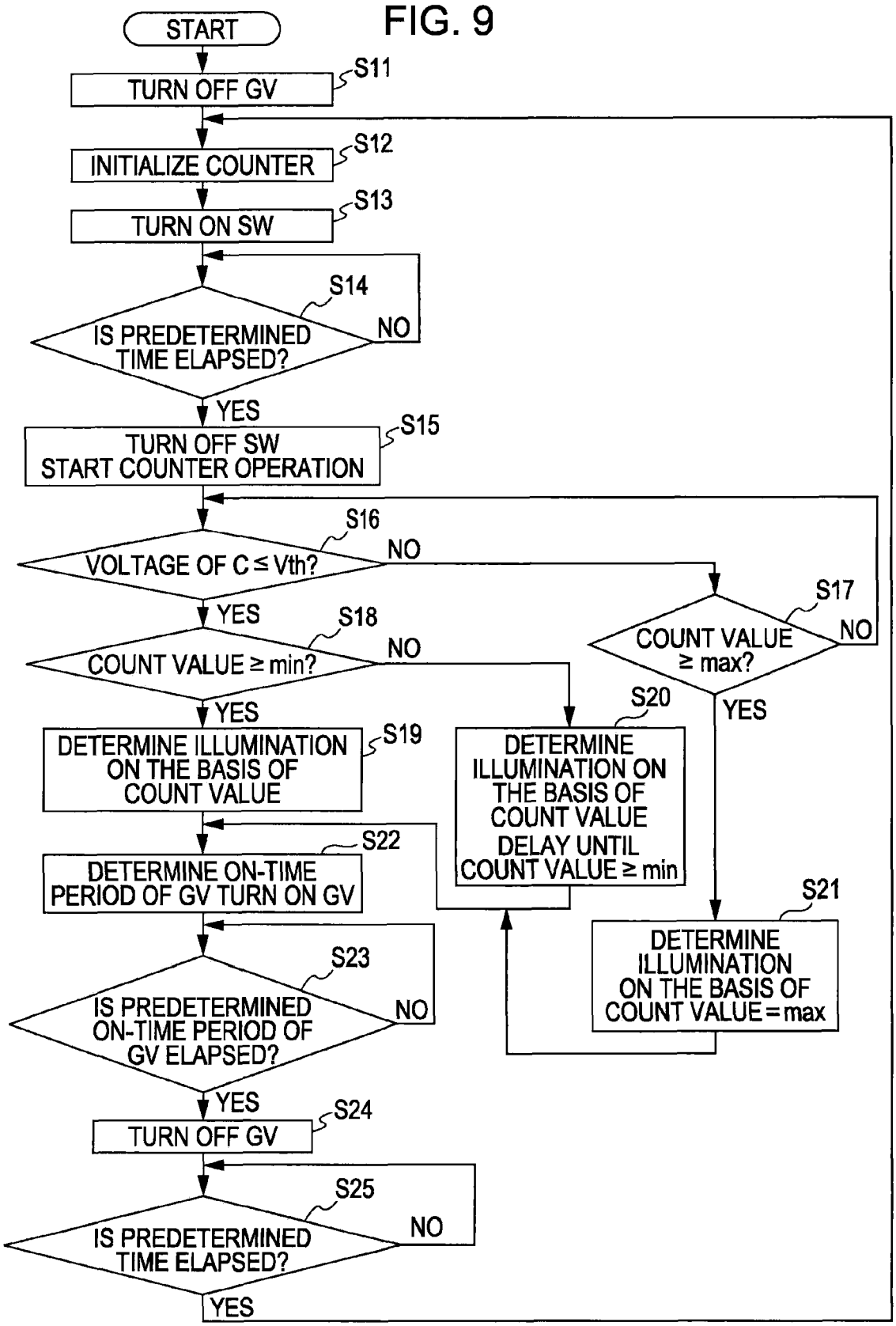
FIG. 9 is a flow chart showing an operation of the optical sensor controller according to the second embodiment.
Figure 10A:
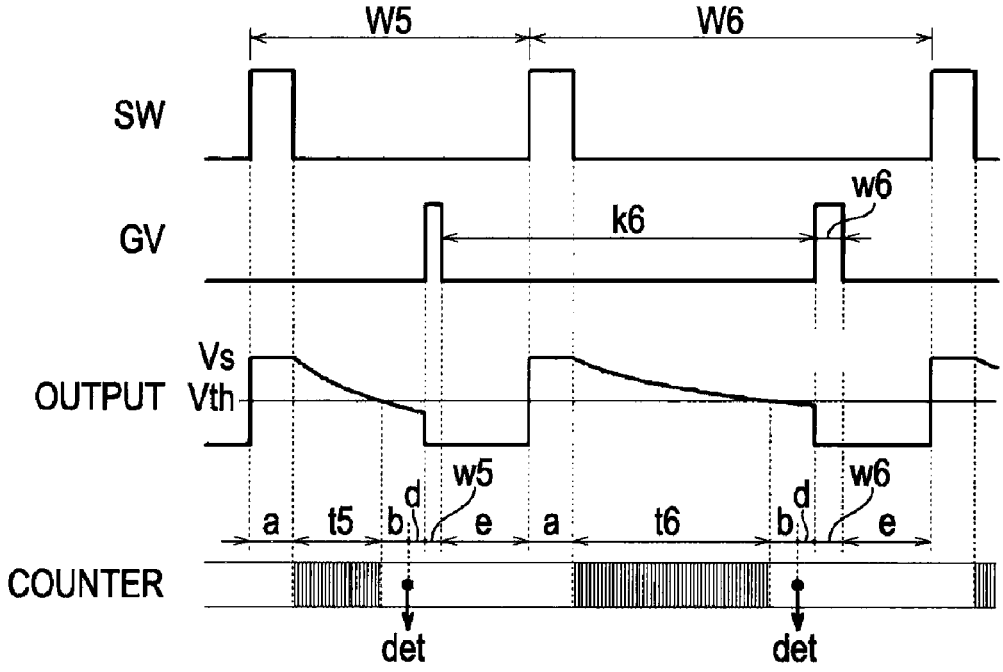
FIG. 10A is a time chart showing waveforms of respective parts when the optical sensor controller according to the second embodiment is in a normal illumination state.
Figure 10B:
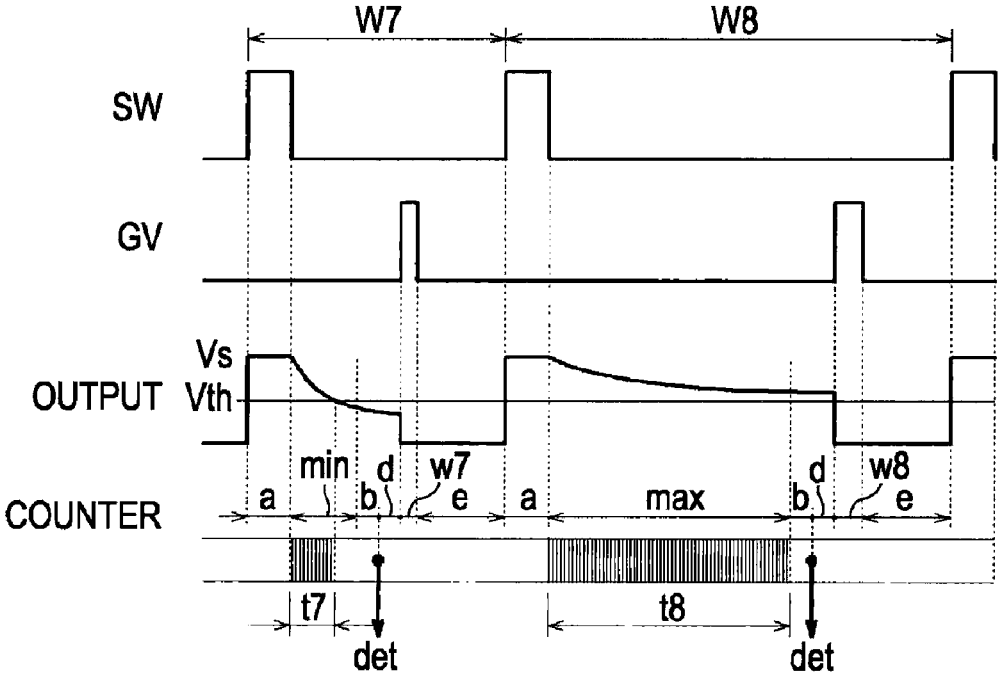
FIG. 10B is a time chart showing waveforms of respective parts when the optical sensor controller is in an abnormal state.

FIG. 1 is a block diagram showing a main part of a liquid crystal display device according to the embodiments. FIG. 2 is a top view perspectively showing a color filter substrate of the liquid crystal display device according to the embodiments. FIG. 3 is a top view showing an outline of one sub-pixel of the liquid crystal display device according to the embodiments. FIG. 4 is a cross-sectional view taken along the line IV-IV in FIG. 3. FIG. 5 is a cross-sectional view showing an outline of an optical detector of the liquid crystal display device according to the embodiments. FIG. 6 is an equivalent circuit diagram showing the optical detector in FIG. 4. FIG. 7 is a flowchart showing an operation of an optical sensor controller according to the first embodiment. FIG. 8A is a time chart showing waveforms of respective parts when the optical sensor controller according to the first embodiment is in a normal illumination state, and FIG. 8B is a time chart showing waveforms of respective parts when the optical sensor controller is in an abnormal state. FIG. 9 is a flow chart showing an operation of the optical sensor controller according to the second embodiment. FIG. 10A is a time chart showing waveforms of respective parts when the optical sensor controller according to the second embodiment is in a normal illumination state, and FIG. 10B is a time chart showing waveforms of respective parts when the optical sensor controller is in an abnormal state.

First, a configuration of a liquid crystal display device 10 according to the embodiments will be described with reference to FIGS. 1 to 6. The liquid crystal display device 10 is a transmissive liquid crystal display device of an FFS (Fringe Field Switching) mode of a lateral electric field system, and includes a liquid crystal display panel 11, a controller substrate 12, and a backlight unit 13 as shown in FIG. 1. The backlight unit 13 corresponds to an illumination unit according to the invention. In addition, as shown in FIG. 4, a first polarizing plate 14 is attached to the rear surface side of the liquid crystal display panel 11, and a second polarizing plate 15 is attached to the display surface side thereof. The backlight unit 13 is disposed on the rear surface side of the first polarizing plate 14. Although it is not shown in the drawing, a controller substrate 12 is disposed on the rear surface side of the backlight unit 13. The controller substrate 12 is electrically connected to the liquid crystal display panel 11 and the backlight unit 13 by means of a flexible wiring substrate.

As shown in FIG. 2, the liquid crystal display panel 11 has a broad display region 16 formed at the center thereof. An optical sensor region 17 is formed above the display region 16. A signal line wiring region 18 is formed below the display region 16. Scanning line wiring regions 19 are formed on both left and right sides of the display region 16 and both left and right sides of a region below the display region 16. Common wiring regions 20 are formed on the left and right sides and the up and down sides of the display region 16. A driving driver IC21 and an external connection terminal 22 are formed below the liquid crystal display panel 11.

In the display region 16, for example, three sub-pixels of R (red), G (green), and B (blue) form one pixel, and a plurality of pixels is formed in a row direction (scanning line direction) and a column direction (signal line direction). As shown in FIG. 4, the liquid crystal display panel 11 has a configuration in which a liquid crystal layer LC is sandwiched between an array substrate AR and a color filter substrate CF.

The array substrate AR has a base which is a first transparent substrate 23 formed of transparent insulating glass, quartz, plastic, or the like. As shown in FIG. 3, scanning lines 24 are formed on the first transparent substrate 23 so as to face the liquid crystal layer LC, where the scanning lines 24 formed of metal such as aluminum or molybdenum are formed above and below the sub-pixels in an X-axis direction (row direction). A gate electrode G extends from each scanning line 24 to a portion on the left side and below the sub-pixels.

In addition, a transparent gate insulating film 25 formed of silicon nitride or silicon oxide is laminated so as to cover the exposed portions of the scanning line 24, the gate electrode G, and the first transparent substrate 23. In a top view, a semiconductor layer 26 formed of amorphous silicon or polycrystalline silicon is formed on the gate insulating film 25 overlapping with the gate electrode G. A plurality of signal lines 27 formed of metal such as aluminum or molybdenum is formed on the gate insulating film 25 so as to be disposed on the left and right sides of the sub-pixels in a Y-axis direction (column direction). A source electrode S extends from each signal line 27, and the source electrode S partially contacts with a surface of the semiconductor layer 26.

A drain electrode D simultaneously formed of the same material as those of the signal line 27 and the source electrode S is formed on the gate insulating film 25. The drain electrode D is disposed adjacent to the source electrode S so as to partially contact with the semiconductor layer 26. A region surrounded by the adjacent scanning lines 24 and the adjacent signal lines 27 of the liquid crystal display panel 11 corresponds to one sub-pixel region. In addition, the gate electrode G, the gate insulating film 25, the semiconductor layer 26, the source electrode S, and the drain electrode D form a TFT which is a switching element. The TFT is formed for each sub-pixel.

A transparent passivation film 28 formed of, for example, silicon nitride, silicon oxide, or the like is laminated so as to cover the exposed portions of the signal line 27, the TFT, and the gate insulating film 25. In addition, an interlayer film 29 formed of, for example, a transparent resin material such as photoresist is laminated so as to cover the passivation film 28. A lower electrode 30 formed of a transparent conductive material such as ITO (Indium Thin Oxide) or IZO (Indium Zinc Oxide) is formed on the interlayer film 29. The lower electrode 30 is electrically connected to the drain electrode D via a contact hole 31 penetrating the interlayer film 29 and the passivation film 28. For this reason, the lower electrode 30 functions as a pixel electrode.

An interelectrode insulating film 32 is formed of an inorganic insulating film such as silicon oxide or silicon nitride so as to cover the lower electrode 30. The interelectrode insulating film 32 is formed at a lower temperature than that of the passivation film 28 so that the surfaces of the lower electrode 30 and the interlayer film 29 are not rough. In addition, an upper electrode 33 formed of a transparent conductive material such as ITO or IZO is formed on the surfaces of the lower electrode 30 and the interelectrode insulating film 32 on the side of the liquid crystal layer LC. For example, as shown in FIG. 3, slit-shaped openings 34 are formed in the upper electrode 33 so as to extend in different directions about the center in the column direction for each sub-pixel. The slit-shaped openings formed at the center in the column direction are connected to each other in a U-shape.

Each slit-shaped openings 34 is formed by performing exposure and etching using photolithography on the upper electrode 33. A first alignment film 35 is formed on the surface of the upper electrode 33 and the inner surface of the slit-shaped opening 34. A rubbing direction of the first alignment film 35 faces an extension direction of the scanning line 24 from the state where the slit-shaped opening 34 is formed. An extension direction of the slit-shaped opening 34 is inclined by about 5 to 25° with respect to the rubbing direction. Accordingly, when an electric field is applied between the lower electrode 30 and the upper electrode 33, liquid crystal molecules can rotate in different directions in the regions above and below the center in the column direction, thereby obtaining a satisfactory viewing angle characteristic.

In addition, the shape of the slit-shaped opening 34 is not limited to the shape shown in FIG. 3. That is, all the slit-shaped openings 34 may be formed in a U-shape, and the slit-shaped openings 34 extending in different directions may not be connected to each other. Further, the slit-shaped opening 34 may be formed in a U-shape in a lengthwise direction along the signal line 27 or may be formed in a bar shape without a curved portion. Particularly, in the bar shape without the curved portion, the extension direction of the slit-shaped opening 34 may be in parallel or inclined along the scanning line 24 or the extension direction of the slit-shaped opening 34 may be in parallel or inclined in the lengthwise direction along the signal line 27.

Next, the color filter substrate CF will be described. The color filter substrate CF has a base which is a second transparent substrate 36 formed of a transparent insulating glass, quartz, plastic, or the like. A color filter layer 37 and a light shielding member 38 are formed on the second transparent substrate 36 so that light having different color (for example, R, G, or B) for each sub-pixel transmits therethrough. An overcoat layer 40 formed of, for example, a transparent resin material such as photoresist is laminated so as to cover the color filter layer 37 and the light shielding member 38. A second alignment film 41 is formed of, for example, polyimide so as to cover the overcoat layer 40. In addition, a rubbing process is performed on the second alignment film 41 in a direction opposite to the rubbing direction of the first alignment film 35.

In addition, the color filter substrate CF and the array substrate AR formed as described above are disposed to face each other, the peripheral edge portions thereof are sealed by a seal member (not shown), and then the liquid crystal layer LC is sealed in the inside of a seal area formed between the array substrate AR and the color filter substrate CF, thereby obtaining the liquid crystal display panel 11 according to the embodiments. Subsequently, the first polarizing plate 14 is attached to the rear surface side of the array substrate AR of the liquid crystal display panel 11 according to the embodiments, the backlight unit 13 is disposed thereon, and then the second polarizing plate 15 is attached to the front surface side of the color filter substrate CF, thereby obtaining the liquid crystal display device 10 according to the embodiments.

Next, a configuration of the optical sensor region 17 of the liquid crystal display device 10 according to the first embodiment will be described with reference to FIGS. 1, 2, 4, 5, and 6. The optical sensor region 17 has one or a plurality of optical detectors 42. Each of the optical detectors 42 includes an optical sensor TFTL formed by a TFT, a capacitor C, and a switch SW, and is formed on the first transparent substrate 23 of the array substrate AR. As shown in FIG. 5, the optical sensor TFTL formed by the TFT includes a gate electrode GL which is formed on the first transparent substrate 23, the gate insulating film 25 which covers the gate electrode GL, a semiconductor layer 43 which is formed on the gate insulating film 25 so as to overlap with the gate electrode GL in a top view, and source and drain electrodes SL and DL which partially overlap with the semiconductor layer 43 and are disposed adjacent to each other. Likewise, the optical sensor TFTL formed by the TFT has the same configuration as that of the TFT functioning as the switching element formed on the display region, and is simultaneously formed with the TFT functioning as the switching element.

The capacitor C includes a capacitor lower electrode 44 which is formed on the first transparent substrate 23 in the vicinity of the gate electrode GL, the gate insulating film 25 which covers the capacitor lower electrode 44, and a capacitor upper electrode UC which is formed on the gate insulating film 25 so as to overlap with the capacitor lower electrode 44 in a top view. In addition, the capacitor upper electrode UC is integrally formed with the source electrode SL of the optical sensor TFTL formed by the TFT. The switch SW includes a gate electrode GS which is formed on the first transparent substrate 23, the gate insulating film 25 which cover the gate electrode GS, a semiconductor layer 45 which is formed on the gate insulating film 25 so as to overlap with the gate electrode GS in a top view, source and drain electrodes SS and DS which partially overlap with the semiconductor layer 45 and are disposed adjacent to each other, and a light shielding member 46 which covers the semiconductor layer 45 in a top view. In addition, the source electrode SL of the optical sensor TFTL formed by the TFT, the capacitor upper electrode UC, and the drain electrode DS of the switch SW are integrally formed so as to have the same electrical potential. The capacitor C and the switch SW are simultaneously formed with the TFT functioning as the switching element formed on the display region.

As shown in FIG. 6, the drain electrode DS of the switch SW is connected to the capacitor C. A voltage Vs for charging the capacitor C is applied to the source electrode SS, and a SW control signal for turning on or off the switch SW is input to the gate electrode GS. Since the capacitor lower electrode 44 of the capacitor C is grounded, the capacitor C is charged when the switch SW is turned on, and the capacitor C is not charged when the switch SW is turned off. The drain electrode DL of the optical sensor TFTL formed by the TFT is grounded, the source electrode SL is connected to the capacitor upper electrode UC of the capacitor C, and then a GV control signal for turning on or off the optical sensor TFTL formed by the TFT is input to the gate electrode GL.

Accordingly, when the optical sensor TFTL formed by the TFT is turned on (in the case of the application of a positive bias voltage), the electric charge accumulated in the capacitor C is discharged. When the optical sensor TFTL is turned off (in the case of the application of a negative bias voltage), the electric charge accumulated in the capacitor C is gradually discharged by a leakage current in accordance with illumination irradiated to the optical sensor TFTL formed by the TFT. The leakage current becomes larger as illumination of external light becomes higher. In addition, a voltage of the source electrode SL of the capacitor C is obtained as an output of the optical detector 42. Further, since the switch SW is shielded by the light shielding member 46, the electric discharge of the capacitor C is not substantially caused by the leakage current of the switch SW.

Next, the controller substrate 12 will be described. As shown in FIG. 1, the controller substrate 12 includes an optical sensor driving circuit 47 which drives the optical detector 42 so as to output the illumination of the external light and a backlight unit controller 48 which controls the brightness of the backlight unit 13. The optical sensor driving circuit 47 includes a first power source 49 which supplies a fixed reference voltage Vs to the optical detector 42, a second power source 50 which applies a threshold voltage Vth, a comparator 51 which compares the output voltage of the optical detector 42 with the threshold voltage Vth of the second power source 50, an optical sensor controller 52 which outputs the SW control signal and the GV control signal to the optical detector 42 on the basis of an output of the comparator 51 so as to drive the optical detector 42, and an illumination measurer 53 which outputs a signal corresponding to the illumination of the external light to the backlight unit controller 48 in proportion to an electric discharge time of the capacitor C supplied from the optical sensor controller 52.

First Embodiment

Next, an operation of the optical sensor driving circuit 47 of the liquid crystal display device 10 according to the first embodiment will be described with reference to FIGS. 1, 7, and 8. When the optical sensor driving circuit 47 starts to be operated in a power-on state, the optical sensor controller 52 outputs the GV control signal so that a voltage GV of the gate electrode GL of the optical sensor TFTL formed by the TFT is in an off state (inverse bias state) (step S11). Accordingly, a current flowing between the source electrode SL and the drain electrode DL of the optical sensor TFTL formed by the TFT is only a leakage current generated by the light. Then, the optical sensor controller 52 initializes an internal counter (not shown) (step S12). The counter has a function of measuring time by counting the number of pulses in accordance with a clock pulse signal of a predetermined frequency. Then, the optical sensor controller 52 turns on the switch SW (step S13), and outputs a SW control signal after a predetermined time a (see FIG. 8) (step S14) so as to turn off the switch SW and to start the operation of the counter (step S15). The capacitor C is fully charged within the predetermined time a, and a voltage (an output of the optical detector 42) of the capacitor C becomes the voltage Vs.

When the switch SW is turned off in step S15, the voltage of the capacitor C decreases in accordance with the illumination of the external light due to the leakage current of the optical sensor TFTL formed by the TFT. Since the leakage current of the optical sensor TFTL becomes larger as the illumination of the external light becomes higher (as the peripheral environment of the optical sensor TFTL becomes brighter), the voltage of the capacitor C decreases faster as the illumination of the external light becomes higher. In step S16, the optical sensor controller 52 determines whether the voltage of the capacitor C becomes a value not more than the threshold value Vth on the basis of the input signal of the comparator 51.

When the voltage of the capacitor C does not become the value not more than the threshold value Vth (N) in step S16, the optical sensor controller 52 determines whether a count value is not less than a voltage measuring maximum time max in step S17. Then, when the count value is less than the voltage measuring maximum time max (N) in step S17, the operation in step S16 is carried out again. When the count value is determined as a value not less than the voltage measuring maximum time max (Y) in step S17, the determination result shows the case where the illumination of the external light is very low (very dark). Accordingly, in step S21, the count value corresponding to the maximum time max is stored in an internal register (not shown) and is output to the illumination measurer 53, and the illumination measurer 53 outputs a signal of an illumination value corresponding to the count value to the backlight unit controller 48. Then, the operation in step S12 is carried out. In addition, the maximum time max is set so as to exit the loop from step S16 to step S17.

When the voltage of the capacitor C becomes the value not more than the threshold value Vth in step S16 (Y), the optical sensor controller 52 determines whether the count value is larger than a voltage measuring minimum time min in step S18. When the count value is determined as a value smaller than the voltage measuring minimum time min in step S18 (N), the determination result shows the case where the illumination of the external light is very high (very bright). Accordingly, in step S20, a predetermined time is delayed until the count value is not less than the voltage measuring minimum time min. Then, the count value corresponding to the minimum time min is stored in the internal register and is output to the illumination measurer 53, and the illumination measurer 53 outputs a signal of an illumination value corresponding to the count value to the backlight unit controller 48. Then, the operation in step S12 is carried out.

In addition, when the count value is determined as a value not less than the voltage measuring minimum time min in step S18 (Y), the determination result shows a normal illumination state. Accordingly, in step S19, the current count value is stored in the internal register and is output to the illumination measurer 53, and the illumination measurer 53 outputs a signal of an illumination value corresponding to the count value to the backlight unit controller 48. Accordingly, the backlight unit controller 48 controls the brightness of the backlight unit 13 on the basis of the received illumination signal. After step S19, the optical sensor controller 52 returns to the operation in step S12, and carries out the next illumination detecting operation.

FIG. 8A is a time chart showing waveforms of the respective parts in step S19 (in a normal illumination state), where the waveforms are obtained in the bright and dark states. In the bright and dark states, the time periods t1 and t2 are different from each other, where each of the time periods t1 and t2 indicates a time period during which the voltage of the capacitor C decreases to the threshold value. In the bright and dark states, an on-time period a, a process time period b, and a process time period c of the bright state are the same as those of the dark state, where the on-time period a indicates a time period during which the voltage of the capacitor C is charged upon turning on the switch SW, the process time period b indicates a time period during which the voltage of the capacitor C reaches the threshold value and the illumination determination is carried out, and the process time period c indicates a time period during which the switch SW is turned on after the illumination determination. One period W1 in the bright state is a+t1+b+c, one period W2 in the dark state is a+t2+b+c, and then t1≠t2. Accordingly, the period W1 in the bright state is shorter than the period W2 in the dark state (W1<W2).

Figure 11:
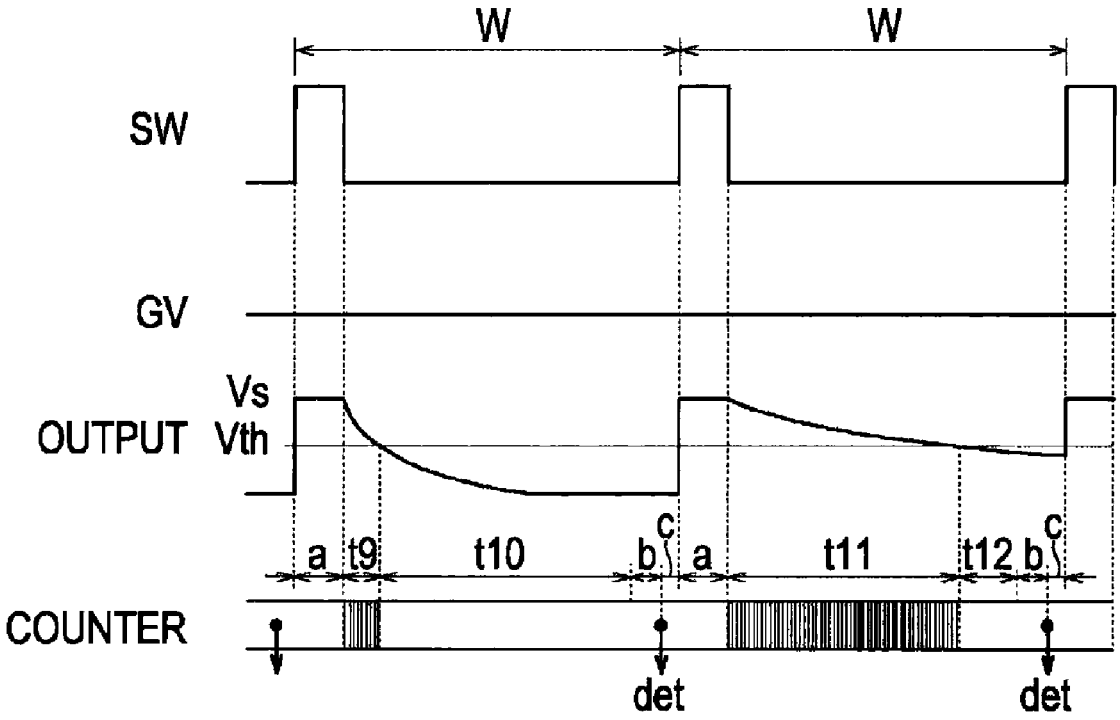
FIG. 11 is a time chart showing waveforms of respective parts when a known optical sensor controller measures an illumination.

In the optical sensor controller 52 according to this embodiment, the delay time periods t10 and t12 shown in the known example in FIG. 11 do not exist after the voltage of the capacitor C reaches the threshold value. Then, an illumination determination det is carried out after the process time period b, the switch SW is turned on after the process time period c, and then the charging operation is carried out. Accordingly, in the optical sensor controller 52 according to this embodiment, the illumination determination can be carried out quickly in the bright state.

Further, FIG. 8B is a time chart showing waveforms of the respective parts (in an abnormal illumination state) in step S20 and step S21, where the waveforms are obtained in the very bright and dark states. One period W3 in the very bright state is a+min+b+c, and one period W4 in the very dark state is a+max+b+c. In all the very bright and dark states, the delay time periods t10 and t12 shown in the known example in FIG. 11 do not exist after the voltage of the capacitor C reaches the threshold value. Then, an illumination determination det is carried out after the process time period b, the switch SW is turned on after the process time period c, and then the charging operation is carried out.

Furthermore, in the very bright state, since a predetermined time is delayed so as not to exceed the process speed of the optical sensor controller 52 even when the voltage of the capacitor C quickly reaches the threshold value, it is possible to avoid an abnormal state. Additionally, in the very dark state or the abnormal state, when the voltage of the capacitor C does not easily reach the threshold value, it is possible to immediately exit the delay time after a predetermined maximum time max.

Second Embodiment

Next, an operation of the optical sensor controller 52 of the liquid crystal display device 10 according to the second embodiment will be described with reference to FIGS. 1, 9, and 11. In addition, in the optical sensor controller 52 according to the second embodiment, the same reference numerals will be given to the same components as those of the optical sensor controller 52 according to the first embodiment, and the detailed description thereof will be omitted.

Step S11 to step S21 in the flowchart of the optical sensor controller 52 according to the second embodiment shown in FIG. 9 are the same as step S11 to step S21 in the flowchart of the optical sensor controller 52 according to the first embodiment shown in FIG. 7. When step S19, step S20, and step S21 end, the optical sensor controller 52 according to the second embodiment carries out step S22, the period during which the gate electrode GL of the optical sensor TFTL formed by the TFT is turned on is calculated as described below by using a factor of the count value stored in the register, and then the gate electrode GL is turned on during the calculated period (step S22 to step S24). Then, a predetermined time e (see FIGS. 10A and 10B) is delayed (step S25), and the operation in step S12 is carried out after the predetermined delay time so as to carry out the next illumination detection operation.

FIG. 10A is a time chart showing waveforms of the respective parts (in a normal illumination state) in step S19, where the waveforms are obtained in the bright and dark states. In the bright and dark states, the time periods t5 and t6 are different from each other, and the time periods w5 and w6 are different from each other, where each of the time periods t5 and t6 indicates a time period during which the voltage of the capacitor C decreases to the threshold value, and each of the time periods w5 and w6 indicates a time period during which the gate electrode GL is turned on. In addition, in the bright and dark sates, an on-time period a, a process time period b, a process time period d, and a process time period e of the bright state are the same as those of the dark state, where the on-time period a indicates a time period during which the voltage of the capacitor C is charged upon turning on the switch SW, the process time period b indicates a time period during which the voltage of the capacitor C reaches the threshold value and the illumination determination is carried out, the process time period d indicates a time period during which the gate electrode GL is turned on after the illumination determination, and the process time period e indicates a time period during which the gate electrode GL is turned off and the switch SW is turned on.

Then, in step S22, the time periods W5 and W6 during which the gate electrode GL is turned on in proportion to the precedent voltage decreasing time of the capacitor C are calculated so as to have the uniform ratio between the time periods during which the gate electrode GL is turned on and off. For example, when the ratio between the time periods during which the gate electrode GL is turned on and off is set to 1:400, w6=k6/400=(e+a+t6+b+d)/400 in FIG. 10A. Here, since the e, a, b, and d are uniform irrespective of the illumination, it is possible to calculate the w6 in such a manner that the t6 is used as the factor of a linear simple equation. Likewise, when the gate electrode GL is turned on, the optical sensor TFTL formed by the TFT is turned on, and the remaining electric charge of the capacitor C is discharged.

Likewise, in the optical sensor controller 52 according to the second embodiment, it is possible to suppress a variation in threshold value of the optical sensor TFTL formed by the TFT caused by the biased polarity in such a manner that the gate electrode GL of the optical sensor TFTL formed by the TFT is periodically turned on at a predetermined timing. In addition, since the on-time period of the gate electrode GL is set so as to have the uniform ratio between the time periods during which the gate electrode GL is turned on and off, it is possible to reliably suppress a variation in threshold value of the optical sensor TFTL formed by the TFT, and thus to maintain the reliability in the detection precision of the illumination of the external light. Even in the optical sensor controller 52 according to the second embodiment, the delay time periods t10 and t12 shown in the known example in FIG. 11 do not exist after the voltage of the capacitor C reaches the threshold value. Then, the illumination determination det is carried out after the process time period b, the switch SW is turned on after the process time period c, and then the charging operation is carried out.

Further, in the optical sensor controller 52 according to the second embodiment, since a predetermined time is delayed so as not to exceed the process speed of the optical sensor controller 52 even when the voltage of the capacitor C rapidly reaches the threshold value in the very bright state, it is possible to avoid the occurrence of the detection error. Additionally, in the optical sensor controller 52 according to the second embodiment, when the voltage of the capacitor C does not easily reach the threshold value in the very dark state or the abnormal state, it is possible to immediately exit the delay time after a predetermined maximum time max without the occurrence of the detection error. In the optical sensor controller 52 according to the second embodiment, even in the very bright and dark states like step S20 and step S21 (in the abnormal state) as shown in FIG. 10B, as in the case of the first embodiment, it is possible to adopt the method in which a positive bias voltage is applied to the gate electrode GL so as to turn on the gate electrode GL during the time periods w7 and w8.

Furthermore, in the above-described first and second embodiments, there is described the case where the illumination of the backlight unit of the liquid crystal display device is controlled, but the invention is not limited to thereto. For example, the invention may be applied to the case where the illumination of the front light of the liquid crystal display device is controlled or the brightness itself of the display screens of various display devices such as a CRT, an LED display device, a plasma display device, and an organic EL display device is controlled.

The entire disclosure of Japanese Patent Application No. 2008-297670, filed Nov. 21, 2008 is expressly incorporated by reference herein.

What is claimed is:

1. A display device comprising:

a display panel;

an optical detector which includes an optical sensor formed by a thin film transistor for detecting external light and a capacitor connected between a pair of electrodes of the optical sensor;

a switch which turns on or off a charging operation of the capacitor;

an optical sensor controller which controls the switch to be turned on or off and measures illumination of the external light on the basis of a time period during which the switch is turned off and a voltage of the capacitor becomes a value not more than a threshold value; and a controller which controls brightness of the display panel on the basis of an output of the optical sensor controller, wherein after the optical sensor controller detects a fact that the voltage of the capacitor becomes the value not more than the threshold value, the optical sensor controller turns on the switch after a predetermined time.

2. The display device according to claim 1, wherein the pair of electrodes of the optical sensor is a source electrode and a drain electrode.

3. The display device according to claim 2, wherein after the optical sensor controller detects a fact that the voltage of the capacitor becomes the value not more than the threshold value, the optical sensor controller applies a positive bias voltage to a gate electrode of the optical sensor before turning on the switch.

4. The display device according to claim 3, wherein the optical sensor controller sets a time period during which the positive bias voltage is applied to the gate electrode of the optical sensor so as to be proportional to a time period during which the switch is turned off in a precedent process and the voltage of the capacitor becomes the value not more than the threshold value.

5. The display device according to claim 1, wherein the optical sensor controller stores in advance a lower limit value of the time period during which the voltage of the capacitor becomes the value not more than the threshold value, and wherein in the case where the time period during which the voltage of the capacitor becomes the value not more than the threshold value is shorter than the lower limit value, the optical sensor controller adopts the lower limit value as an illumination measurement value of the external light and turns on the switch after the lower limit value and the predetermined time.

6. The display device according to claim 1, wherein the optical sensor controller stores in advance an upper limit value of the time period during which the voltage of the capacitor becomes the value not more than the threshold value, and wherein in the case where the voltage of the capacitor does not become the value not more than the threshold value even at the upper limit value, the optical sensor controller adopts the upper limit value as an illumination measurement value of the external light and turns on the switch after the upper limit value and the predetermined time.

* * * * *